US007162778B2

(12) United States Patent
Pan

(10) Patent No.: US 7,162,778 B2
(45) Date of Patent: Jan. 16, 2007

(54) MASK STRAP ADJUSTER

(75) Inventor: Chen-Lieh Pan, Yilan Hsien (TW)

(73) Assignee: Water Square Sports Co., Ltd., Taipei Hsien (TW)

( * ) Notice: Subject to any disclaimer, the term of this patent is extended or adjusted under 35 U.S.C. 154(b) by 122 days.

(21) Appl. No.: 11/104,533

(22) Filed: Apr. 13, 2005

(65) Prior Publication Data

US 2006/0230584 A1 Oct. 19, 2006

(51) Int. Cl.
*A44B 11/24* (2006.01)

(52) U.S. Cl. ..... 24/170; 24/593.11; 24/DIG. 48

(58) Field of Classification Search ..... 24/70 ST, 24/69 R, 68 SK, 68 A, 68 R, 70 R, 70 SK, 24/69 ST, 71 R, 71 ST, 71 TD, 71 SK, 32, 24/270, 271, 272, 275, 21, 24, 25, 170, 171, 24/191, 193, 197, 196, 578.15, 265 BC, 265 EC, 24/265 CD, 265 WS, 593.11, 633, DIG. 48, 24/DIG. 43, DIG. 47; 351/43, 156; 2/426, 2/452, 418

See application file for complete search history.

(56) References Cited

U.S. PATENT DOCUMENTS 215,956 A * 5/1879 Miller ..... 24/574.1
794,098 A * 7/1905 Hainsfurther ..... 24/593.11
4,727,630 A * 3/1988 Alan ..... 24/593.11
4,795,384 A * 1/1989 Hattori ..... 441/64
5,774,953 A * 7/1998 Mao ..... 24/579.09
6,126,122 A * 10/2000 Ismert ..... 248/74.1
6,185,794 B1 * 2/2001 Maggi ..... 24/170
6,219,889 B1 * 4/2001 Lovato et al. ..... 24/587.1
6,467,133 B1 * 10/2002 Chen ..... 24/68 SK
6,691,377 B1 * 2/2004 Pan ..... 24/170
6,966,102 B1 * 11/2005 Shiue ..... 24/196
2003/0182770 A1 * 10/2003 Koshoji ..... 24/265 WS
2003/0233737 A1 * 12/2003 Chen-Lieh ..... 24/170
2005/0050692 A1 * 3/2005 Shiue ..... 24/68 R

* cited by examiner

*Primary Examiner*—Jack W. Lavinder
(74) *Attorney, Agent, or Firm*—Rosenberg, Klein & Lee

(57) ABSTRACT

A mask strap adjuster attaches a strap with right triangular ribs to a mask, allows the strap to be tightened by pulling the strap and comprises a base, a cover and a connector. The base has two corresponding moveable caps. Each cap has two nubs. The cover is mounted on the base and has a pawl and two nubs. The pawl engages the ribs on the strap to allow the strap to be tightened by simply pulling the strap. The nubs of the cover are pressed selectively by the nubs on the caps and press the cover away from the base and the pawl away from the ribs to loosen the strap. The cover and the base can be short.

8 Claims, 5 Drawing Sheets

MASK STRAP ADJUSTER

BACKGROUND OF THE INVENTION

1. Field of the Invention

The present invention relates to a mask strap adjuster, and more particularly to a scuba diving mask strap adjuster that is smaller.

2. Description of Related Art

Water sports are very popular. A mask is basic equipment to allow a swimmer to be able to see when underwater. Since people's heads are different sizes, swimmers need to adjust the mask's strap for a snug fit. The strap needs a mask strap adjuster to adjust the strap.

With reference to FIG. 8, a conventional mask strap adjuster comprises a base (50), a tongue (51) and two arms (52).

The base (50) has a front end, a rear end, a top side, a bottom side, a top notch (53), a bottom notch (54) and a pin. The top notch (53) and the bottom notch (54) are formed respectively in the top and bottom sides near the rear end of the base (50). The pin is mounted rotatably in the rear end of the base (50).

The tongue (51) has a proximal end, a distal end, a pawl, a top edge, a bottom edge, an inner surface, two inclined surfaces (55) and a mounting post (56). The proximal end of the tongue (51) is connected to the front end of the base (50). The pawl is formed at and protrudes in from the distal end. The inclined surfaces (55) are formed respectively on and extend out from the top and bottom edges near the distal end of the tongue (51). The mounting post (56) is formed at and protrudes from the inner surface near the proximal end of the tongue (51) and extends into the mask to attach the base (50) to the mask.

Each arm (52) has a proximal end, a distal end, an inner surface and a nub (57). The proximal ends of the arms (52) are connected respectively to the top and bottom sides of the tongue (51) near the proximal end of the tongue (51). The nub (57) is formed respectively on and extends out of each inner surface of the arms (52) near the distal end of the arm (52). The nubs (57) extend respectively into the top and bottom notches (53, 54) in the base (50) and selectively press the inclined surfaces (55) on the tongue (51).

A strap (60) is threaded around the rolling rod in the base (50) and has an outer surface and multiple triangular ribs (61). The triangular ribs (61) are formed on and protrude from the outer surface of the strap (60) and are engaged selectively by the distal end of the tongue (51).

The triangular ribs (61) on the strap (60) keep the strap (60) from loosening. To loosen the strap (60), the two arms (52) are pushed down, and the nubs (57) press the inclined surfaces (55) on the tongue (51), which forces the pawl on the tongue (51) to disengage from the triangular ribs (61) on the strap (60). The strap (60) can be pulled or released to adjust the tension on the strap (60).

When the tension of the strap (60) is adjusted, the arms (52) are released, and the pawl on the tongue (51) engages a triangular rib (61) on the strap (60) to hold the strap (60) tight.

However, the tongue (51) must be long enough to be flexible to engage the triangular ribs (61) on the strap (60). If the length of the tongue (51) is not long enough, the tongue (51) will not be strong enough to keep the strap (60) from loosening. Consequently, the base (50) and tongue (51) cannot be small.

Furthermore, the arms (52) easily break from the tongue (51). If the arms (52) break, the tension on the strap (60) cannot be released.

To overcome the shortcomings, the present invention provides a mask strap adjuster to obviate or mitigate the aforementioned problems.

SUMMARY OF THE INVENTION

The primary objective of the present invention is to provide a mask strap adjuster that is small.

The mask strap adjuster attaches a conventional strap with right triangular ribs to a mask, allows the strap to be tightened by pulling the strap and comprises a base, a cover and a connector. The base has two corresponding moveable caps. Each cap has two nubs. The cover is mounted on the base and has a pawl and two nubs. The pawl engages the ribs on the strap to allow the strap to be tightened by simply pulling the strap. The nubs on the cover are pressed selectively by the nubs on the caps and press the cover away from the base and the pawl away from the ribs to loosen the strap. The cover and the base can be short.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
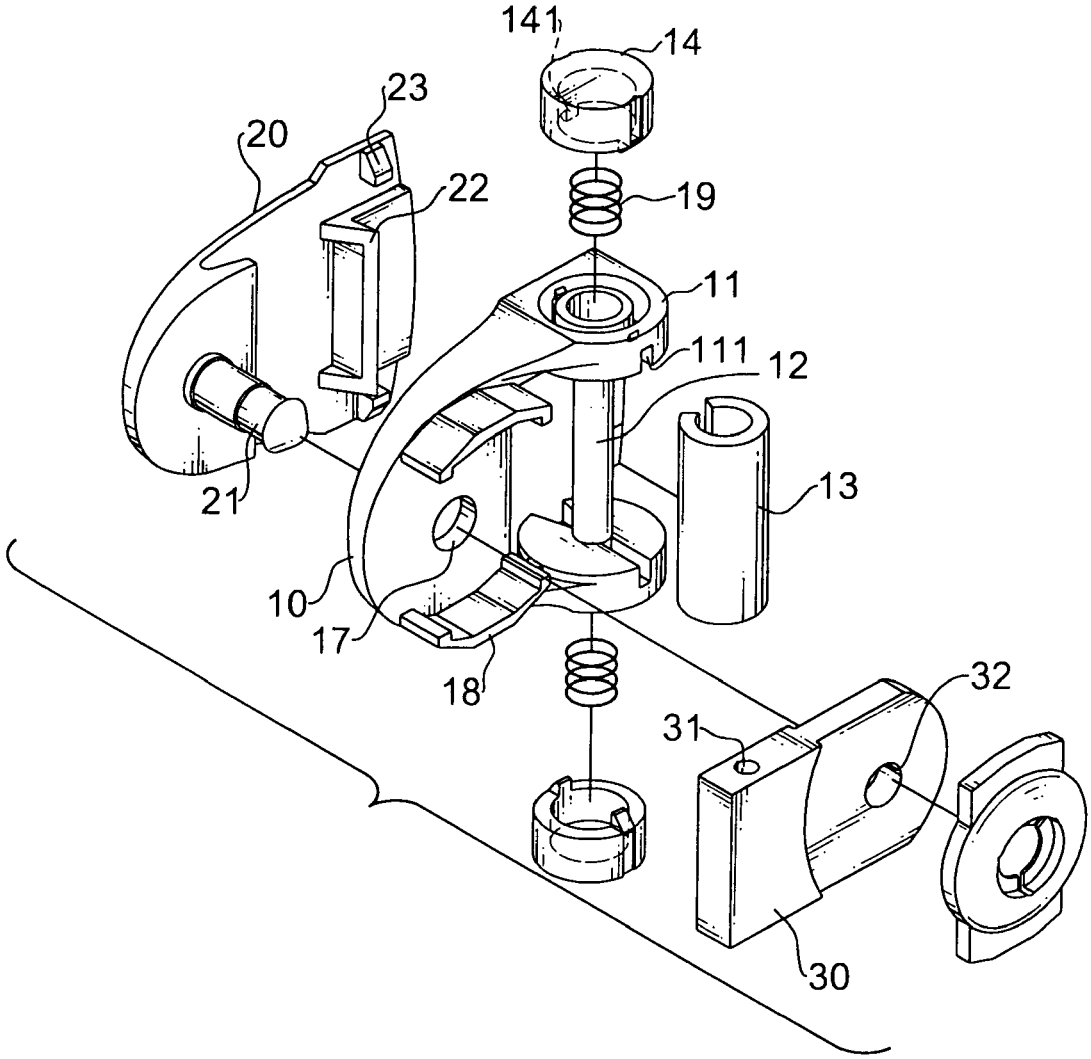
FIG. 1 is an exploded perspective view of a first embodiment of a mask strap adjuster in accordance with the present invention.

With reference to FIGS. 1, 2, 6 and 7, a mask strap adjuster in accordance with the present invention attaches a strap (40) to a mask, allows the strap (40) to be tightened by pulling the strap (40) and comprises a base (10, 10A, 10B), a cover (20, 20A, 20B) and an optional connector (30).

The strap (40) is conventional and has an inside surface, an outside surface, two ends and multiple right triangular ribs (41). The ends are selectively connected respectively to mask strap adjusters. The right triangular ribs (41) are formed on the outside surface of the strap (40) near the ends, and each right triangular rib (41) has a perpendicular edge and an inclined edge. The perpendicular edge of each right triangular rib (41) is closer to the nearest end of the strap (40) than the inclined edge.

In a first embodiment of the mask strap adjuster in accordance with the present invention, the base (10) can be connected to the mask directly or through the optional connection (30) and has a proximal end, a distal end, a top side, a bottom side, an outer surface, two cap recesses (11), a stationary shaft (12), an optional rolling shaft (13), two caps (14), two springs (19), a cover recess (16), an optional through hole (17) and two optional clips (18). The cap recesses (11) are formed respectively in the top and bottom sides of the base (10) near the distal end of the base (10) and correspond to each other. Each cap recess (11) has a bottom and two notches (111). The notches (111) are formed in the base (10) through the bottom of the recess (11) and correspond to each other. The stationary shaft (12) is mounted between the two cap recesses (11) and aligned with a center of the cap recesses (11). The rolling shaft (13) is mounted rotatably on the stationary shaft (12) and may be a sleeve or a split sleeve. The caps (14) are slidably mounted respectively in the cap recesses (11), and each cap (14) has a bottom and two nubs (141). The nubs (141) are formed at the bottom of the cap (14) and extend into the notches (111) in the cap recesses (11). The springs (19) are mounted respectively in the cap recesses (11) between the caps (14) and the bottoms of the cap recesses (11). The cover recess (16) is formed in the outer surface of the base (10). The through hole (17) is formed through the base (10) near the proximal end and communicates with the cover recess (16). The clips (18) are formed respectively in and protrude inward from the top and bottom edges of the base (10) near the proximal end of the base (10).

The cover (20) is mounted in the cover recess (16) in the base (10) and has an inner surface, a top edge, a bottom edge, a proximal end, a mounting post (21), a pawl (22) and two nubs (23). The mounting post (21) is formed on and extends out from the inner surface of the cover (20) and extends through the through hole (17) in the base (10).

Figure 2:
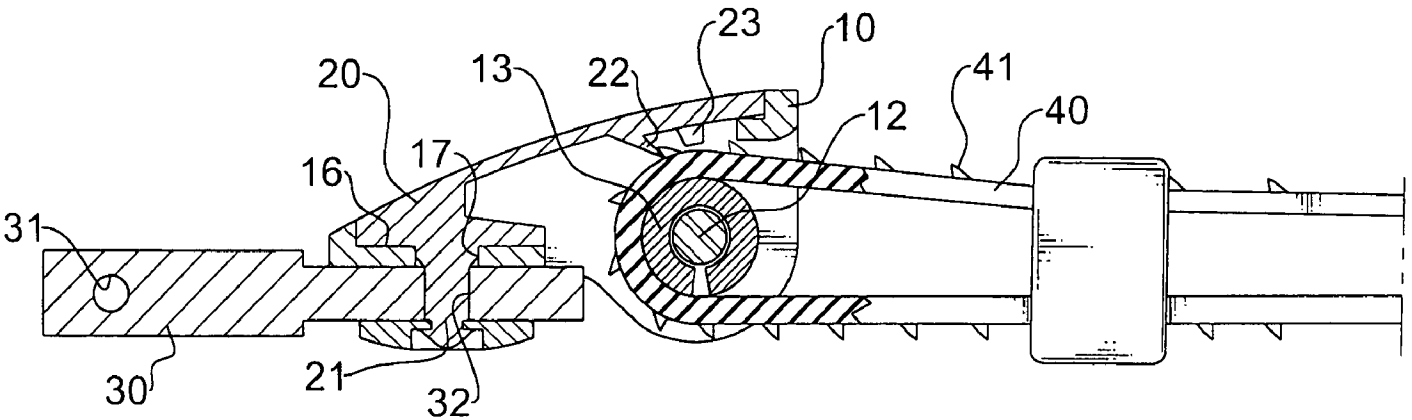
FIG. 2 is a bottom view in partial section of the mask strap adjuster in FIG. 1.
Figure 3:
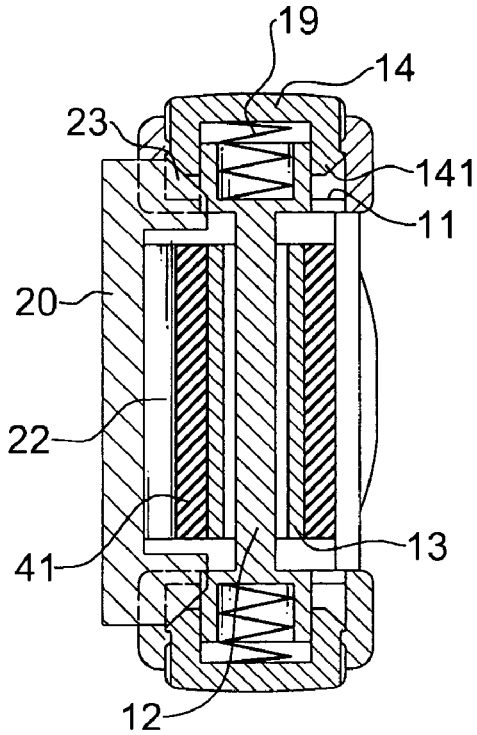
FIG. 3 is a cross sectional rear end view of the mask strap adjuster in FIG. 2.

With further reference to FIGS. 2 and 3, the pawl (22) is formed on the inner surface of the cover (20) near the distal end of the cover (20), engages the perpendicular edges of the right triangular ribs (41) on the strap (40) and slides over the inclined edge of the right triangular ribs (41) when the end of the strap (40) is pulled. The nubs (23) are formed on the inner surface of the cover (20) respectively at the top and bottom edges of the cover (20), correspond to each other and selectively abut the nubs (141) on the cap (14).

Figure 4:
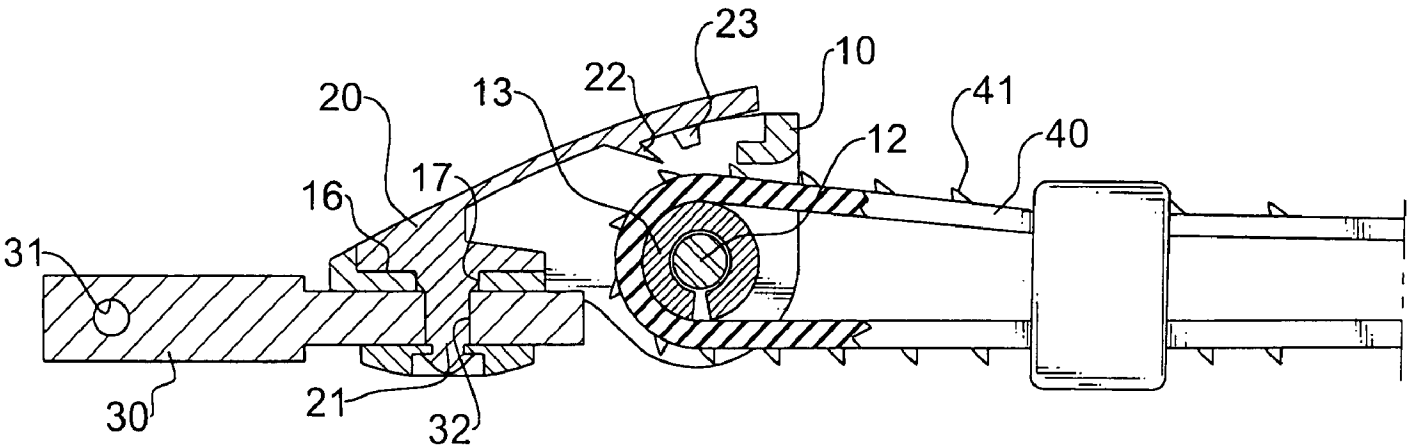
FIG. 4 is an operational bottom view in partial section of the mask strap adjuster in FIG. 1 when the strap is released.
Figure 5:
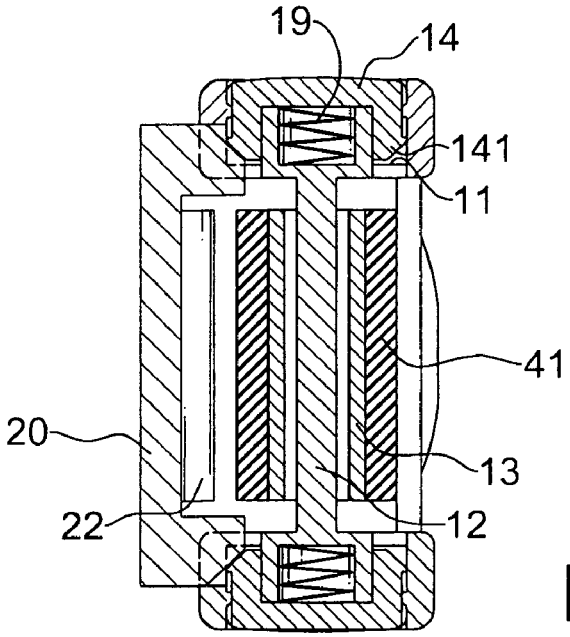
FIG. 5 is an operational cross sectional rear end view of the mask strap adjuster in FIG. 4.

With further reference to FIGS. 4 and 5, pushing the caps (14) into the cap recesses (11) causes the nubs (141) on the caps (14) to press against the nubs (23) on the cover (20), lift the distal end of the cover (20) out of the cover recess (16) in the base (10) and disengage the pawl (22) from the right triangular ribs (41). Disengaging the pawl (22) from the right triangular ribs (41) releases the tension on the strap (40). Releasing the caps (14) causes the pawl (22) to engage the right triangular ribs (41).

The connector (30) is attached pivotally to a mask and securely to the base (10) between the two clips (18) and has a proximal end, a pivot pin hole (31) and a through hole (32). The proximal end is attached pivotally to a bracket on the mask with a pivot pin. The pivot pin hole (31) is formed transversely through the connector (30) near the proximal end of the connector (30), and the pivot pin in the bracket on the mask passes pivotally through the pivot pin hole (31). The through hole (32) is formed through the connector (30), and is mounted securely on the mounting post (21) on the cover (20) with a fastener.

Figure 6:
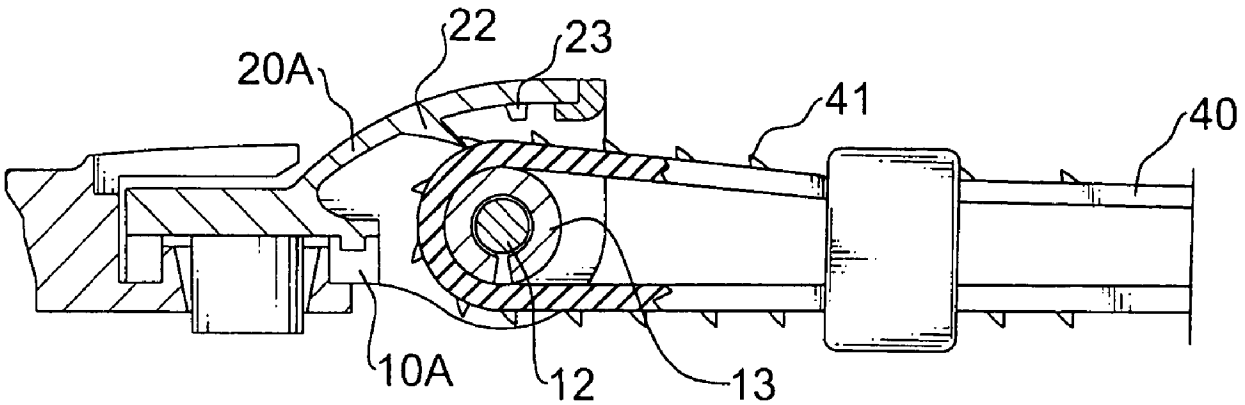
FIG. 6 is a top view in partial section of a second embodiment of the mask strap adjuster in accordance with the present invention.

With further reference to FIG. 6, in a second embodiment of the mask strap adjuster in accordance with the present invention is shown. A part of the base (10A) and a part of the cover (20A) are attached pivotally to a bracket on the mask with the pivot pin.

Figure 7:
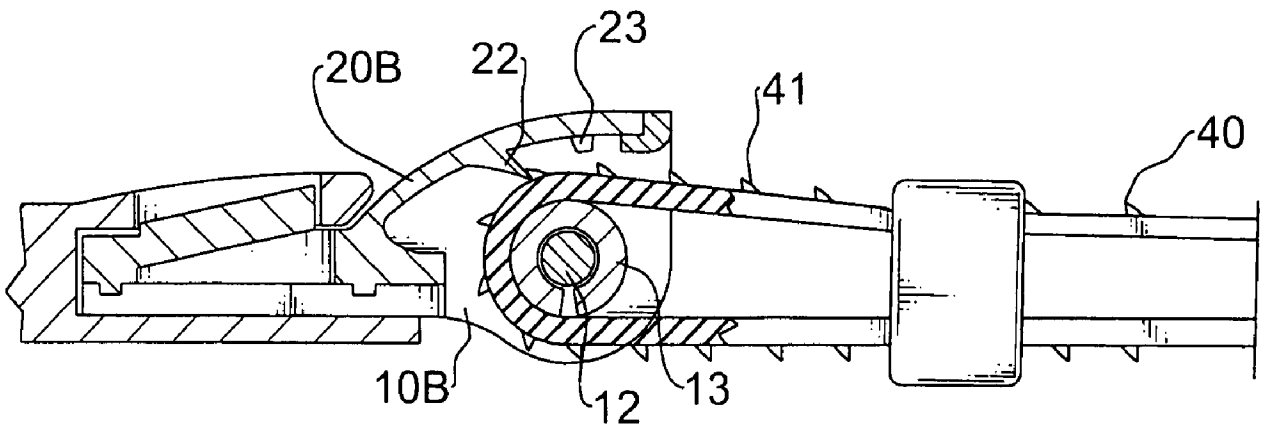
FIG. 7 is a top view in partial section of a third embodiment of the mask strap adjuster in accordance with the present invention.
Figure 8:
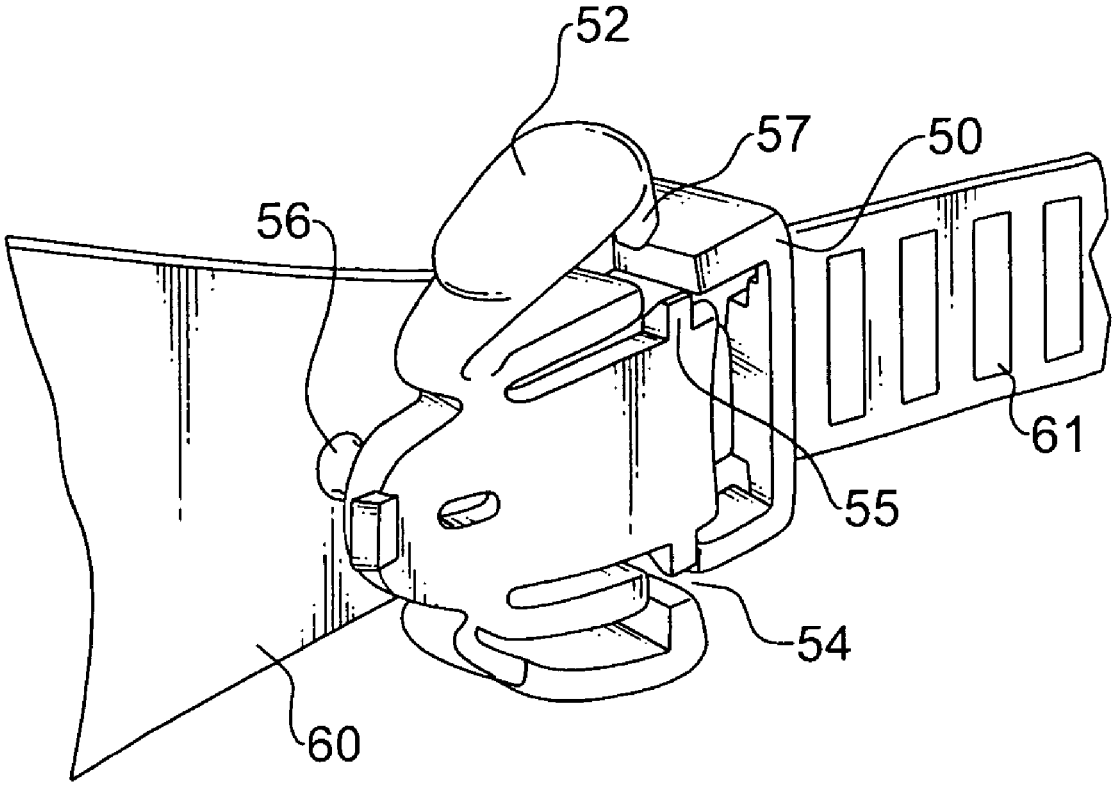
FIG.8 PRIOR ART
FIG. 8 is a perspective view of a conventional mask strap adjuster in accordance with the prior art.

With further reference to FIG. 7, in a third embodiment of the mask strap adjuster in accordance with the present invention is shown. A part of the base (10B) and a part of the cover (20B) are attached pivotally to a bracket on the mask.

In conclusion, the mask strap adjuster is short and durable. The cover (20) is strong enough to hold the strap (40) so the cover (20) can be short and no weak points exist in the structure since the caps (14) are mounted in the cap recesses (11) in the base (10). Furthermore, a diver can easily adjust the strap (40) by squeezing the caps (14) together.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A mask strap adjuster comprises
- a base (10) having
  - a proximal end;
  - a distal end;
  - a top side;
  - a bottom side;
  - an outer surface;
  - two cap recesses (11) formed respectively in the top and bottom sides of the base near the distal end of the base and corresponding to each other, and each recess having
    - a bottom; and
    - two notches (111) formed in the base through the bottom of the recess and corresponding to each other;
  - a stationary shaft (12) mounted between the two cap recesses (11) in the base;
  - two caps (14) slidably mounted respectively in the cap recesses (11), and each cap (14) having
    - a bottom; and
    - two nubs (141) formed at the bottom of the cap (14) and extending into the notches (111) in a corresponding one of the cap recesses (11);
  - two springs (19) mounted respectively in the cap recesses (11) between the caps (14) and the bottoms of the cap recesses (11);
  - a cover recess (16) formed in the outer surface of the base (10);
- a cover (20) mounted in the cover recess (16) in the base and having
  - an inner surface;
  - a top edge;
  - a bottom edge;
  - a proximal end;
  - a pawl (22) formed on the inner surface of the cover near the distal end of the cover (20); and
  - two nubs (23) formed on the inner surface of the cover (20) respectively at the top and bottom edges of the cover (20), corresponding to each other and selectively abutting the nubs (141) on the cap (14).

2. The mask strap adjuster as claimed in claim 1, wherein the base (10) further has a rolling shaft (13) mounted rotatably on the stationary shaft (12) of the base (10).

3. The mask strap adjuster as claimed in claim 2, wherein the rolling shaft (13) is a split sleeve.

4. The mask strap adjuster as claimed in claim 1, wherein the stationary shaft (12) is aligned with a center of the cap recesses (11).

5. The mask strap adjuster as claimed in claim 4, wherein the base (10) further has a through hole (17) formed through the base near the proximal end of the base (10) and communicating with the cover recess (16).

6. The mask strap adjuster as claimed in claim 5, wherein the base (10) further has two clips (18) formed respectively in and protruding from the top and bottom edges of the base (10) near the proximal end of the base (10).

7. The mask strap adjuster as claimed in claim 6, wherein the cover (20) further has a mounting post (21) formed on and extending out from the inner surface of the cover (20) and extending through the through hole (17) in the base (10).

8. The mask strap adjuster as claimed in claim 7 further has a connector (30) adapted to be attached pivotally to a mask and securely to the base between the two clips (18) of the base (10) and having a proximal end adapted to be attached pivotally to a bracket on the mask with a pivot pin;

a pivot pin hole (31) formed transversely through the connector (30) near the proximal end of the connector (30); and a though hole (32) formed through the connector (30) and mounted securely on the mounting post on the cover (20) with a fastener.

* * * * *